US010111006B2

(12) United States Patent
Mao et al.

(10) Patent No.: US 10,111,006 B2
(45) **Date of Patent: *Oct. 23, 2018**

(54) SPEAKER

(71) Applicant: AAC Technologies Pte. Ltd., Singapore (SG)

(72) Inventors: Lubin Mao, Shenzhen (CN); Shun Guo, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/417,148

(22) Filed: Jan. 26, 2017

(65) Prior Publication Data

US 2017/0347196 A1 Nov. 30, 2017

(30) Foreign Application Priority Data

May 26, 2016 (CN) ..... 2016 2 0490424 U

(51) Int. Cl.

| | |
|---|---|
| ***H04R 31/00*** | (2006.01) |
| ***H04R 7/18*** | (2006.01) |
| ***H04R 9/06*** | (2006.01) |
| ***H04R 9/02*** | (2006.01) |
| ***H04R 7/12*** | (2006.01) |

(52) U.S. Cl.
CPC ..... *H04R 7/18* (2013.01); *H04R 7/127* (2013.01); *H04R 9/025* (2013.01); *H04R 9/06* (2013.01); *H04R 2400/11* (2013.01)

(58) Field of Classification Search
CPC combination set(s) only.
See application file for complete search history.

(56) References Cited

U.S. PATENT DOCUMENTS

2016/0381481 A1* 12/2016 Wang ..... H04R 9/025 381/400

* cited by examiner

*Primary Examiner* — Amir Etesam
(74) *Attorney, Agent, or Firm* — Na Xu; IPro, PLLC

(57) ABSTRACT

The present disclosure provides a speaker, including a frame, a vibrating system and a magnet portion accommodated in the frame, the vibrating system includes a diaphragm and a voice coil which drives the diaphragm to vibrate, the diaphragm includes a first suspension at a central position of the diaphragm, a second suspension at an edge position of the diaphragm and a dome connected between the first suspension and the second suspension, an inner periphery of the first suspension is fixed on the magnet portion, an outer periphery of the first suspension is connected with the dome, an inner periphery of the second suspension is connected with the dome, an outer periphery of the second suspension is fixed on the frame, a stiffness of the first suspension is different from a stiffness of the second suspension. Comparing with the related art, the speaker of the present disclosure guarantees sounding effect.

10 Claims, 4 Drawing Sheets

SPEAKER

TECHNICAL FIELD

The present disclosure relates to the field of electro-acoustic converting and, in particular, to a speaker for a portable mobile electronic product.

BACKGROUND

With the arrival of mobile Internet era, the number of smart devices is increasing gradually. Among numerous mobile devices, cellphone is the most common and portable mobile terminal device. At present, a cellphone already has diversified functions, an important function thereof is high quality music play, the speaker in the cellphone is one of the necessities for high quality music play.

Existing speakers generally include a vibrating system composed of a diaphragm and a voice coil, and a magnetic circuit system, the diaphragm is a single diaphragm including an inner suspension and an outer suspension, stiffness of the inner suspension and the outer suspension of a same diaphragm is difficult to be adjusted. Due to the difficulty on adjusting the stiffness of the inner and outer suspensions of the same diaphragm, segmenting vibration of the diaphragm cannot be suppressed, the diaphragm will shake.

Therefore, there is a necessity to provide a new speaker, so as to solve the above problem.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The technical solutions of the present disclosure will be described clearly and completely combining the drawings in the embodiments of the present disclosure, obviously, the described embodiments are only part of the embodiments of the present disclosure, but not all of them. Other embodiments obtained by those skilled in the art without creative work are all belonging to the protection scope of the present disclosure.

Figure 1:
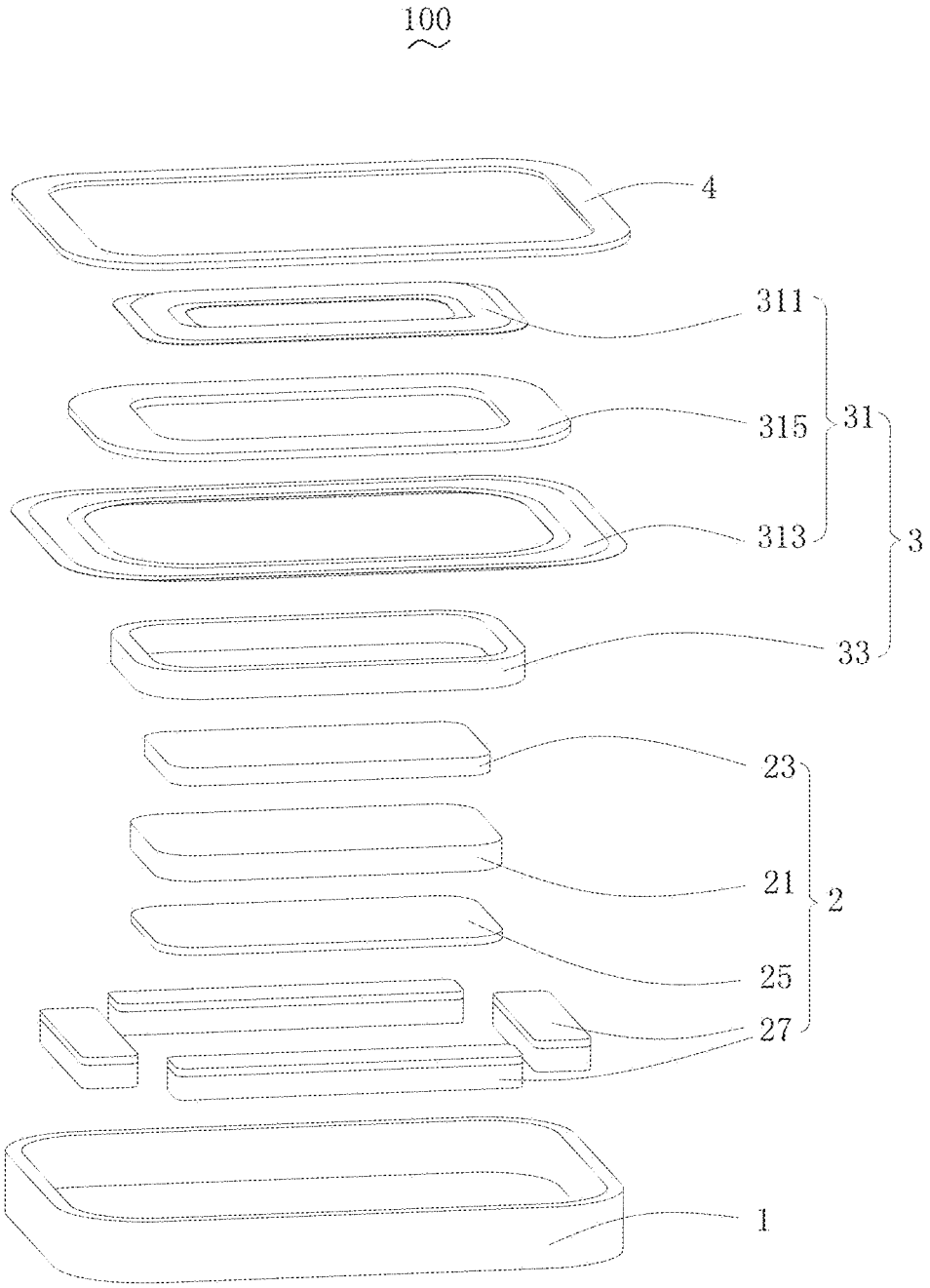
FIG. 1 is a perspective structural exploded view of a speaker in accordance with Embodiment One of the present disclosure.
Figure 2:
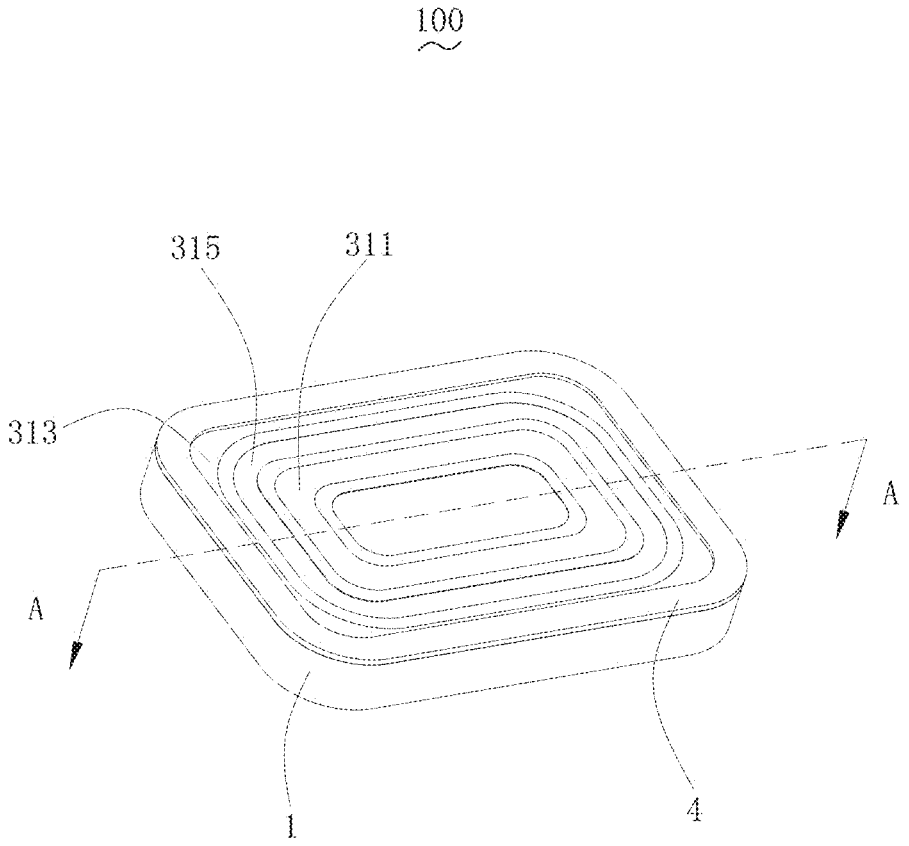
FIG. 2 is a perspective structural view of a speaker in accordance with Embodiment One of the present disclosure.

As shown in FIG. 1 and FIG. 2, the present disclosure provides a speaker 100, including a frame 1, a magnet portion 2 accommodated in the frame 1, a vibrating system 3 held by the frame 1 and driven by the magnet portion 2, and a cover plate 4 which forms accommodating space together with the frame 1 so as to accommodate the magnet portion 2 and the vibrating system 3.

The frame 1 can be a plastic frame; the frame 1 can also be a yoke which, at this time, forms a magnetic circuit system together with the magnet portion 2.

Figure 3:
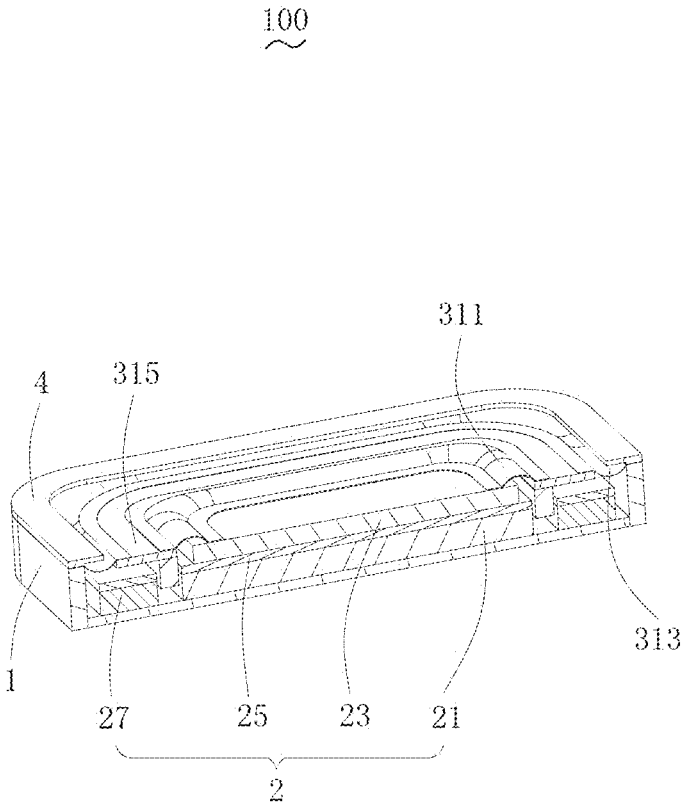
FIG. 3 is a sectional view along A-A line shown in FIG. 2.

Please refer to FIG. 3, the magnet portion 2 includes a first magnet 21 and a second magnet 23 provided above the first magnet 21, the size of the second magnet 23 is smaller than the size of the first magnet 21. The first magnet 21 and the second magnet 23 are arranged in a manner such that poles with a same polarity are opposite to each other, that is, surfaces of the first magnet 21 and the second magnet 23 with a same polarity are fitted with each other, so as to achieve good magnetic circuit properties. In the present embodiment, the S pole surfaces of the first magnet 21 and the second magnet 23 are fitted, in other embodiments, it may be that the N pole surfaces thereof are fitted, a specific polarity is not limited. Optionally, the magnet portion 2 further includes a pole plate 25 clamped between the first magnet 21 and the second magnet 23 and a plurality of auxiliary magnets 27 provided at periphery of the magnet portion 2, the auxiliary magnets 27 form a magnetic gap in between with the magnet portion 2. The pole plate 25 and the auxiliary magnet 27 are used for improving magnetic field properties.

The vibration system 3 includes a diaphragm 31 and a voice coil 33 driving the diaphragm 31 to sound. The diaphragm 31 includes a first suspension 311 at a central position of the diaphragm, a second suspension 313 at an edge position of the diaphragm and a dome 315 connected between the first suspension 311 and the second suspension 313, the dome 315 is of a plate shape, the first suspension 311 and the second suspension 313 are both of a hollow ring structure. An inner periphery of the first suspension 311 is fixed on the surface of the second magnet 23, an outer periphery of the first suspension 311 is connected with the dome 315; an inner periphery of the second suspension 313 is connected with the dome 315, an outer periphery of the second suspension 313 is fixed on the frame 1. The outer periphery of the first suspension 311 and the inner periphery of the second suspension 313 are both attached onto an upper surface of the dome 315, the voice coil is adhered on a lower surface of the dome 315.

The voice coil 33 is connected with the dome 315 and surrounds the magnet portion 2 and is inserted into a magnetic gap between the auxiliary magnet 27 and the magnet portion 2, its position is closer to the first suspension 311 with respect to the second suspension 313, in a vibrating direction of the diaphragm 31, an orthographic projection of the voice coil 33 does not overlap an orthographic projection of the first suspension 311.

The dome 315 vibrates at a side of the magnet portion 2 under the driving of the voice coil 33, and the size of the second magnet 23 is smaller than the size of the first magnet 21, so as to avoid the vibration of the first suspension 311, and the end of the second magnet 23 is adjacent to the inner side of the first suspension 311, and the end of the first magnet 21 is close to the outer side of the first suspension 311.

The first suspension 311 and the second suspension 313 adopt different material, and the first suspension 311 and the second suspension 313 have different thickness. The stiffness of the first suspension 311 and the second suspension 313 can be adjusted through the thickness difference and the material difference. The stiffness of the suspension refers to rigidity, the larger the stiffness, the less the suspension will deform. Under the case that the total stiffness of the first suspension 311 and the second suspension 313 is not changed, adjusting a stiffness ratio of the first suspension 311 and the second suspension 313, which can effectively suppress the segmenting movement of the diaphragm, so as to reduce shaking of the diaphragm. Since the first suspension is close to the voice coil 33 (driving position), the fact that the stiffness of the first suspension 311 is larger than the stiffness of the second suspension 313 is advantageous to suppress the segmenting vibration of the dome 315.

Figure 4:
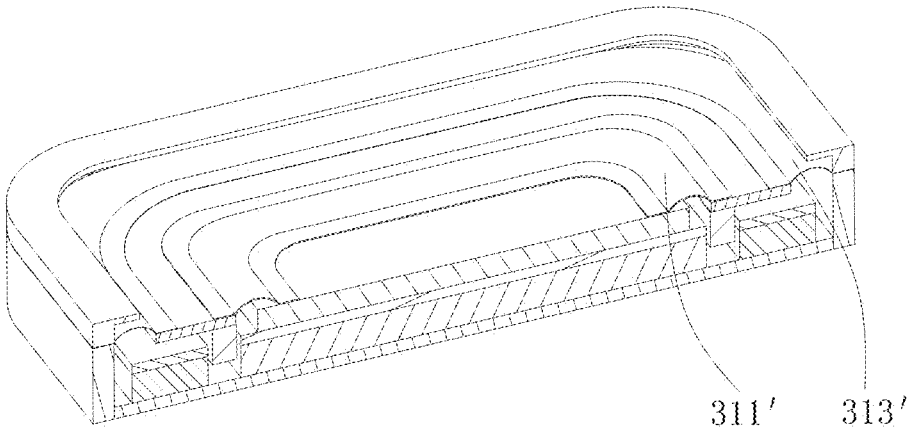
FIG. 4 is a sectional view of a speaker in accordance with Embodiment Two of the present disclosure.

The opening direction of the first suspension 311 and the second suspension 313 is towards any direction in the vibrating direction of the diaphragm 31, and the openings of the first suspension 311 and the second suspension 313 can towards a same direction or different directions. As shown in FIG. 3, the first suspension 311 and the second suspension 313 have different protruding directions, the openings are one upward one downward; as shown in FIG. 4, the first suspension 311', and the second 313' have a same protrusion direction, the openings are both downward.

Comparing with the related art, in the speaker 100 provided by the present disclosure, since the dome 315 is vibrating at the side of the magnet portion 2, the diaphragm 31 can vibrate without being limited by the thickness of the magnet portion 2, the component can be made thin, which effectively meets the requirements of portable electronic products on a lighter and thinner structure of the speaker 100; moreover, through the design of stiffness proportion of the first suspension 311 and the second suspension 313, which reduces acoustic resistance of the diaphragm, the second magnet 23 can avoid the first suspension 311, which can effectively improve the tone quality of the speaker 100, meanwhile guaranteeing that there is not collision noise between the first suspension 311 and the second magnet 23 without affecting the tone quality of the speaker 100.

The above merely shows embodiments of the present disclosure, it should be noted that, improvements can be made by those skilled in the art without departing from the inventive concept of the present disclosure, however, these shall belong to the protection scope of the present disclosure.

What is claimed is:

1. A speaker, comprising:

a frame;

a vibrating system held by the frame, the vibrating system comprises a diaphragm and a voice coil driving the diaphragm to vibrate; and a magnet portion accommodated in the frame and driving the vibrating system, wherein the diaphragm comprises a first suspension at a central position of the diaphragm, a second suspension at an edge position of the diaphragm and a dome connected between the first suspension and the second suspension, an inner periphery of the first suspension is fixed on the magnet portion, an outer periphery of the first suspension is connected with the dome, an inner periphery of the second suspension is connected with the dome, an outer periphery of the second suspension is fixed on the frame, a stiffness of the first suspension is different from a stiffness of the second suspension.

2. The speaker as described in claim 1, wherein the first suspension and the second suspension are made of different materials.

3. The speaker as described in claim 1, wherein the first suspension and the second suspension have different thicknesses.

4. The speaker as described in claim 1, wherein the voice coil is closer to the first suspension with respect to the second suspension, a stiffness of the first suspension is larger than a stiffness of the second suspension.

5. The speaker as described in claim 1, wherein the magnet portion comprises a first magnet and a second magnet provided above the first magnet, the first magnet and the second magnet are arranged in a manner such that poles thereof with a same polarity are opposite to each other, an inner periphery of the first suspension is fitted on a surface of the second magnet.

6. The speaker as described in claim 5, wherein the magnet portion further comprises a pole plate, which is clamped between the first magnet and the second magnet.

7. The speaker as described in claim 5, wherein a size of the second magnet is smaller than a size of the first magnet.

8. The speaker as described in claim 1, further comprising an auxiliary magnet provided at a periphery of the magnet portion, the auxiliary magnet forms a magnetic gap in between with the magnet main portion, the voice coil is hung in the magnetic gap.

9. The speaker as described in claim 1, wherein the first suspension and the second suspension protrude towards a same direction.

10. The speaker as described in claim 1, wherein the first suspension and the second suspension protrude towards different directions.

* * * * *